United States Patent [19]

Hirakawa et al.

[11] 4,337,884

[45] Jul. 6, 1982

[54] SINGLE FACER

[75] Inventors: Tadashi Hirakawa; Hiroaki Sasashige, both of Mihara; Hiroyuki Takenaka; Keiichi Katayama, both of Hiroshima, all of Japan

[73] Assignee: Mitsubishi Jukogyo Kabushiki Kaisha, Tokyo, Japan

[21] Appl. No.: 178,458

[22] Filed: Aug. 15, 1980

[30] Foreign Application Priority Data

Aug. 17, 1979 [JP] Japan ..... 54/113106[U]

[51] Int. Cl.[3] ..... B65H 17/20; B65H 17/28

[52] U.S. Cl. ..... 226/52; 156/472; 226/82; 226/95; 226/168; 226/176

[58] Field of Search ..... 226/52, 53, 59, 60, 226/76, 82, 85, 86, 93, 95, 97, 168, 174, 176, 177, 200; 156/470, 471, 472, 473

[56] References Cited

U.S. PATENT DOCUMENTS

| | | | |
|---|---|---|---|
| 3,231,163 | 1/1966 | Chambers | 226/95 |
| 3,724,735 | 4/1973 | Gay | 226/95 |
| 3,990,935 | 11/1976 | Lehmann | 156/472 |

FOREIGN PATENT DOCUMENTS

| | | | |
|---|---|---|---|
| 2639015 | 3/1978 | Fed. Rep. of Germany | 156/472 |
| 2142591 | 2/1973 | France | 156/472 |
| 1064267 | 4/1967 | United Kingdom | 226/95 |

*Primary Examiner*—Stanley N. Gilreath
*Attorney, Agent, or Firm*—Bernard, Rothwell & Brown

[57] ABSTRACT

A hollow pressure member is provided adjacent the lower corrugating roll of a single facer to apply pressure for effecting bonding of the corrugated web and the liner web. The pressure member is provided, in the area facing the lower corrugating roll, with an arcuate surface having a curvature equal to or exceeding that of a curve extending through the tips of the flutes of the corrugating roll. The pressure member is of circumferential length at least exceeding the distance between two adjacent flutes of the corrugating roll. In one form of the invention the pressure member is provided with a plurality of threaded openings extending from its hollow interior to the arcuate surface and threaded hollow plugs are received within these openings. Each plug includes an aperture for permitting communication between the hollow interior of the pressure member and the arcuate surface thereof. Within the plug, there is provided a ball which is spring-biased toward an opening in the plug at the arcuate surface of the pressure member and closes this opening in the absence of external force. When single-faced board is being manufactured, the balls are forced inwardly against the spring bias, providing a passage for supply of air from the hollow interior of the pressure member to the area between the arcuate surface and the liner web. This provides a gaseous film between the liner web and the arcuate surface, thereby substantially reducing friction therebetween.

In another form of the invention, the aforementioned plugs and spring-biased balls are omitted and the arcuate surface of the pressure member is provided with a plurality of openings which are in continuous communication with the hollow interior of the pressure member. During operation air supplied from a suitable source through the hollow interior passes through these openings and provides a film between the arcuate surface and the liner web to reduce the friction therebetween.

4 Claims, 8 Drawing Figures

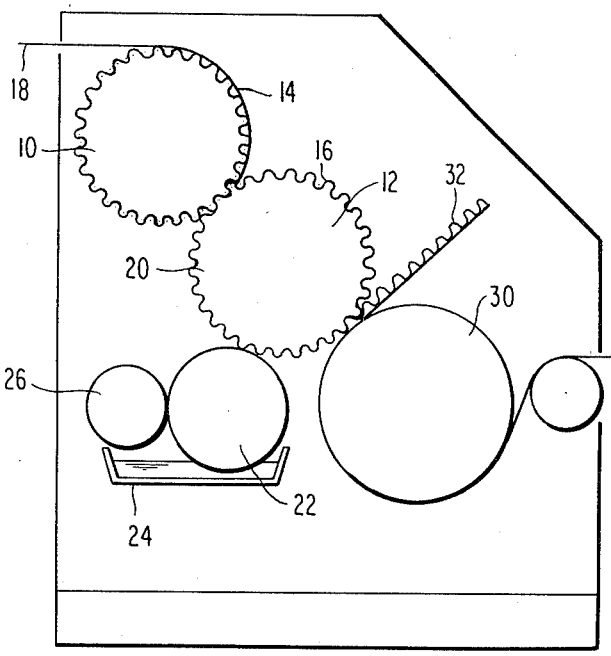
FIG. 1 PRIOR ART
FIG. 2a FIG. 2b
PRIOR ART
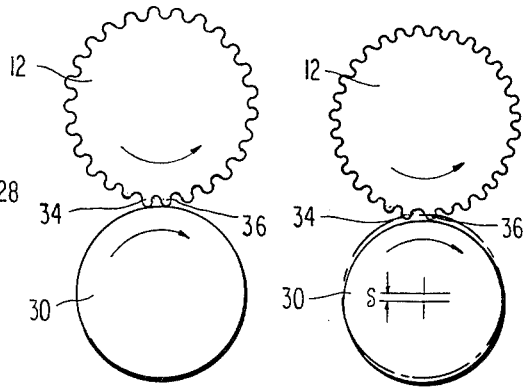
FIG. 3
PRIOR ART
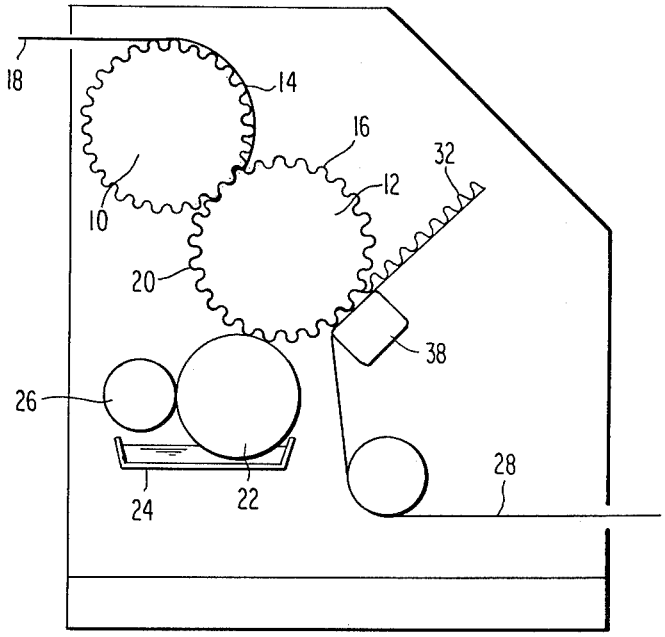
FIG. 4
PRIOR ART
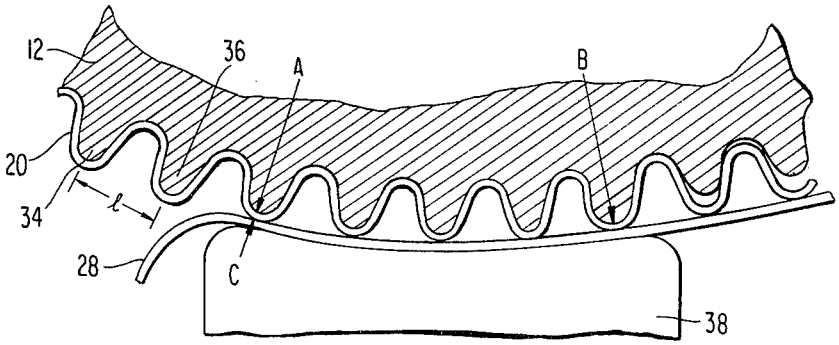

SINGLE FACER

BACKGROUND OF THE INVENTION

1. Field of the Invention

The invention relates to single facers for forming single-faced corrugated board and more particularly to arrangements for effecting bonding of the corrugated web to a liner web to form the single-faced board.

2. Description of the Prior Art

Single facers of the prior art, for example, that shown schematically in FIG. 1 of the accompanying drawings, include conventionally an upper corrugating roll 10 and a lower corrugating roll 12 each of which includes a plurality of longitudinally extending flutes 14 and 16 respectively. The two corrugating rolls are arranged to mesh and the web 18 to be corrugated is supplied between the meshing flutes to form the corrugations therein, the corrugated web being indicated at 20 in FIG. 1.

Conventionally a pasting roll 22, arranged to turn in a bath of paste indicated at 24, is provided for supplying paste to the tips of the corrugated web 20. A doctor roll 26 is provided to control the amount of paste supplied by the pasting roll 22 to the corrugated web 20.

Another web sheet 28, referred to hereinafter as a liner web, is supplied over a pressure roll 30 and brought into engagement with the pasted corrugated web to form the single-faced corrugated board indicated at 32. The pressure roll 30 is positioned adjacent the lower corrugating roll 12 and is arranged to apply pressure to the corrugated web and liner web to effect bonding of these two webs. Normally the upper corrugating roll 10, the lower corrugating roll 12 and the pressure roll 30 are of hollow construction and vapor or high temperature oil is introduced into the internal hollow chamber to heat these rolls and promote the corrugating of the web 18 and the bonding of the corrugated web 20 to the liner web 28.

Prior art apparatus of this type is subject to problems which are best illustrated by reference to FIGS. 2*a* and 2*b* of the accompanying drawing, both of which represent schematically the lower corrugating roll 12 and the pressure roll 30 arranged to bear thereagainst. In FIG. 2*a* two adjacent flutes 34 and 36 are shown in a particular position relative to the pressure roll 30. Turning now to FIG. 2*b* it can be seen that the two rolls 12 and 30 have moved in the direction shown by the arrows by an amount equal to half the distance between adjacent flutes, and flute 34 has moved to a position where it is disposed on a line extending between the centers of the rolls 12 and 30. It can be seen by comparison of FIGS. 2*a* and 2*b* that the aforementioned movement has caused the distance between the shafts of the lower corrugating roll 12 and the pressure roll 30 to be altered so that the distance therebetween has increased by an amount indicated by the dimension $\delta$ in FIG. 2*b*. Because of this forcible displacement and the variation in the distance between the shafts of the two rolls, the cycle of which occurs during an amount of rotation equal to the distance between two adjacent flutes, vibrations occur between the lower corrugating roll 12 and the pressure roll 30. Such relative movement of the two rolls and resulting vibrations not only cause noise but also result in breakage of the corrugated web, when it is of low quality, at the engagement point between the lower corrugating roll and the pressure roll.

In an effort to eliminate such vibration and minimize such breakage of the corrugated web the prior art structure shown in FIG. 3 was developed. The upper and lower corrugating rolls and the pasting roll and associated elements are the same as those shown in FIG. 1 and the same numerals have been applied thereto. However, in the apparatus shown in FIG. 3, a pressure member 38 has been substituted for the pressure roll 30 of the apparatus shown in FIG. 1. This pressure member 38 has a curved or arcuate surface which is opposed to the lower corrugating roll 12 and has a curvature equal to or greater than that of a line extending through the outer surface of the lower corrugating roll, that is through the tips of the flutes of the lower corrugating roll 12. With this construction, the distance between the pressure member 38 and the lower corrugating roll 12 does not vary, and the aforementioned forcible displacement and vibrations of the prior art structure of FIGS. 1 and 2 are eliminated. This can be appreciated by reference to FIG. 4 which illustrates that the distance between the pressure member 38 and the lower corrugating roll 12 does not vary between an engagement point A at the leading edge of the pressure member 38 and an engagement point B at the trailing edge of the pressure member 38, nor at any intermediate point between these two engagement points.

However, the apparatus shown in FIG. 3, while eliminating the aforementioned problem, introduces another problem in the operation of a single facer. The pressure member 38 has a length greater than the distance between two adjacent flutes 34 and 36 shown in FIG. 4, and the pressure member 38 is fixedly positioned so that the arcuate surface thereof remains fixed while the flutes of the lower corrugating roll 12 move past the surface of the pressure member 38. As a result, a friction force occurs between the liner web 28 and the pressure member 38, and this force is applied to the joints between the liner web 28 and the corrugated web 20 between the engagement points A and B, one such joint being indicated at C in FIG. 4. The result of the application of this frictional force is to cause relative movement between the liner web 28 and the corrugated web 20 and hence to cause separation between these two webs. This results in unsatisfactory bonding and unsatisfactory single-faced corrugated board produced in the apparatus.

In accordance with the present invention, these problems and deficiencies in prior art structures have been overcome and a single facer is provided which manufactures a single-faced corrugated board in which the liner web and corrugated web are effectively bonded.

Accordingly, it is an object of this invention to provide a single facer utilizing a pressure member for effecting bonding of the liner web and corrugated web in which provision is made for minimizing the friction introduced in the area between the pressure member and the adjacent lower corrugating roll.

It is a further object of this invention to provide such an apparatus in which the friction force generated by the liner web and the pressure member is reduced so that separation in the joint portions of the liner web and the corrugated web is prevented.

SUMMARY OF THE INVENTION

In carrying out the invention in one form thereof, a hollow pressure member is provided adjacent the lower corrugating roll of a single facer to apply pressure for effecting bonding of the corrugated web and the liner web which pass between the corrugating roll and the pressure member, the liner web being adjacent the surface of the pressure member. The pressure member is provided, in the area facing the lower corrugating roll, with an arcuate surface having a curvature equal to or exceeding that of an arc extending through the tips of the flutes of the corrugating roll. The pressure member is of a circumferential length at least exceeding the distance between two adjacent flutes of the corrugating roll. In one form of the invention the pressure member is provided with a plurality of threaded openings extending from its hollow interior to the arcuate surface and threaded hollow plugs are received within these openings. Each plug includes an aperture for permitting communication between the hollow interior of the pressure member and the arcuate surface thereof. Within each plug, there is provided a ball which is spring-biased toward an opening in the plug at the arcuate surface of the pressure member and closes this opening in the absence of external force. When single-faced corrugated board is being manufactured, the balls are forced inwardly against the spring bias, providing a passage for supply of air from the hollow interior of the pressure member to the area between the arcuate surface and the liner web. This provides a gaseous film between the liner web and the arcuate surface, thereby substantially reducing friction therebetween.

In another form of the invention, the aforementioned plugs and spring-biased balls are omitted and the arcuate surface of the pressure member is provided with a plurality of openings which are in continuous communication with the hollow interior of the pressure member. During operation air supplied from a suitable source through the hollow interior passes through these openings and provides a film between the arcuate surface and the liner web to reduce the friction therebetween.

BRIEF DESCRIPTION OF THE DRAWINGS

FIG. 1 is a side elevation view of a schematic representation of a conventional single facer of the prior art;

Figure 5:
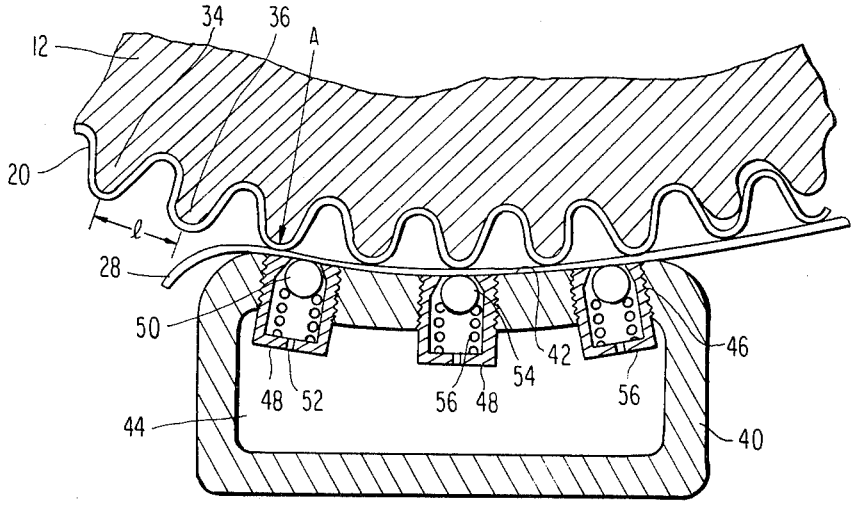
Figure 6A:
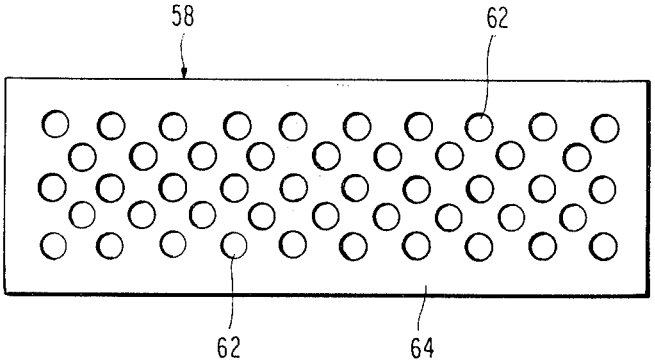
Figure 6B:
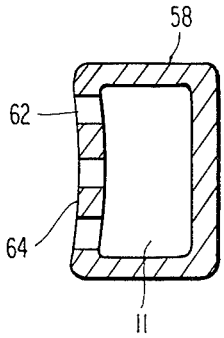

FIGS. *2a* and *2b* illustrate the relative movement of the lower corrugating roll and the pressure roll during operation of the single facer shown in FIG. 1;

FIG. 3 is a side elevation view, also in schematic form, of another conventional single facer of the prior art;

FIG. 4 is an enlarged side elevation view of a portion of the single facer shown in FIG. 3;

FIG. 5 is a sectional side elevation view of a portion of a single facer embodying the present invention;

FIG. *6a* is a plan view of the surface of a modified form of pressure member of this invention; and FIG. *6b* is a sectional elevation view of the pressure member shown in FIG. *6a*.

DESCRIPTION OF THE PREFERRED EMBODIMENTS

Referring now to FIG. 5 there is shown one embodiment of the present invention in which the single facer is the same as that shown in FIGS. 3 and 4 except that a different type of pressure member 40 is employed in lieu of the pressure member 38 of the prior art structure. Thus, as in the single facer shown in FIG. 3, a corrugated web 20 is formed between an upper corrugating roll 10 and a lower corrugating roll 12. Paste is applied to the crests of the flutes of the corrugated web 20 by a pasting roll 22. The corrugated web 20 and a liner web 28 are brought into engagement between the lower corrugating roll 12 and the pressure member 40. Like the pressure member 38, the pressure member 40 shown in FIG. 5 is disposed adjacent the lower corrugating roll 12 in opposed relationship thereto for exerting pressure on the liner web and corrugated web passing between the lower corrugating roll 12 and the pressure member 40. The pressure member 40 has an arcuate surface 42 of a contour substantially conforming to that of an arc extending through the tips of the flutes of the lower corrugating roll 12. More specifically, the curvature of the arcuate surface 42 is equal to or slightly greater than that of an arc extending through the tips of the flutes of the corrugating roll 12. The pressure member 40 has a circumferential length, that is in the direction of the circumference of the lower corrugating roll 12, which is greater than the distance between two adjacent flutes, for example flutes 34 and 36, of the lower corrugating roll 12.

In the form of the invention shown in FIG. 5, the pressure member 40 is formed to provide a hollow portion or chamber 44 therein. The chamber 44 is arranged to communicate through any suitable passage with a conventional blower (not shown) which supplies gaseous fluid, such as air, to the chamber 44. The arcuate surface 42 of the pressure member 40 is provided with a plurality of threaded apertures 46 and a plurality of hollow cup-shaped plugs 48, having threaded external surfaces, are received within the threaded apertures 46. Each of the plugs 48 is provided with a tapered opening 50 adjacent the arcuate surface 42, and the inner end of each plug 48 is provided with an aperture 52 for establishing communication with the hollow chamber 44. Within each of the hollow cup-shaped plugs 48 there is provided a steel ball 54 which is urged toward the tapered opening 50 by a compression spring 56. When the ball 54 is seated in the tapered opening 50 under the bias of the spring 56 a portion of the ball projects slightly above the arcuate surface 42 of the pressure member 40. Thus, when the liner web 28 is pressed toward the arcuate surface 42 as a result of mutual pressure exerted between the lower corrugating roll 12 and the pressure member 40, the balls 54 are forced inwardly against the bias of the springs 56 so as to provide a space between each ball and the tapered opening 50 of the plug 48. This permits air or other gaseous fluid supplied from the blower through the chamber 44 and the apertures 52 to pass through the tapered openings 50 and flow between the liner web 28 and the arcuate surface 42 to form a layer of air therebetween. This significantly reduces the friction between the arcuate surface 42 of the pressure member 40 and the liner web 28 moving thereover.

The operation of the embodiment shown in FIG. 5 is as follows. The corrugated web 20 is formed as shown in FIG. 1 and passes adjacent the pasting roll 22. The pasting roll applies paste to the flute crests of the corrugated web. The corrugated web is then moved into engagement with the liner web 28 supplied from a different side, as shown in FIG. 1, and the two webs are caused to move between the lower corrugating roll 20 and the pressure member 40. As the liner web 28 moves across the surface 42 of the pressure member, the pressure causes the steel balls 54 to be depressed so that the top portion thereof lies within a surface coincident with the arcuate top surface 42 of the pressure member 40. When this occurs, a gap is provided between each ball 54 and the corresponding tapered opening 50 so that air supplied from the blower through the hollow chamber 44 of the pressure member flows through the apertures 52, the openings 50 and between the liner web 28 and the surface 42 to provide a layer of air between the liner web 28 and the surface 42. Because of this layer of air the liner web 28 can move over the surface 42 with significantly reduced friction and the problems previously encountered at the joints between the liner web 28 and the corrugated web 20 are eliminated.

Referring now to FIGS. *6a* and *6b*, there is shown a modified form of the invention which includes a modified form of the pressure member. As there shown, the pressure member 58, like the pressure member 40 of the first form of the invention just described, is formed with a hollow chamber 60 which is arranged to communicate through any suitable passage with a conventional blower (not shown). In this case a plurality of apertures 62 are provided in the arcuate face 64 of the pressure member 58. The plugs and the associated balls and springs employed in the first form of invention described are omitted and the apertures 64 are left in open communication between the hollow chamber 60 and the liner web 28 which, during operation of the single facer, passes over the arcuate surface 64. In this form of invention, as in the form just described, when the liner web 28 and the corrugated web are subjected to the pressurizing step between the lower corrugating roll 12 and the pressure member 58, air flowing through the apertures 62 from the hollow chamber 60 passes into the area between the arcuate surface 64 and the liner web 28 to provide a friction-reducing layer of air therebetween.

Thus, in accordance with both forms of the invention described above, a layer of air is formed between the liner web and the pressure member. The frictional force occurring between the pressure member and the liner web as the liner web and corrugated web are being bonded is thereby reduced. This reduction in friction serves to prevent separation of the joint portions of the corrugated web and the liner web from occurring.

While specific embodiments of the invention have been illustrated and described, modifications thereof will occur to those skilled in the art and it is intended, by the appended claims, to cover all such modifications as come within the spirit and scope of this invention.

What is claimed is:

1. In a single facer including a corrugating roll having flutes extending along its peripheral surface for forming a corrugating web, (a) a pressure member opposed to said corrugating roll for pressing a liner web against the corrugated web to form a single-faced corrugated board;

(b) said pressure member having an arcuate surface substantially conforming to the contour of an arc extending through the tips of said flutes and having a length in the circumferential direction of said roll which is greater than the distance between two adjacent flutes thereof;

(c) means for providing a gaseous layer between said arcuate surface of said pressure member and the liner web;

(d) said pressure member including a chamber for receiving gas and said means for providing said gaseous layer includes a plurality of openings formed in said chamber;

(e) a plurality of spring-biased members positioned adjacent said openings and projecting slightly beyond said arcuate surface of said pressure member; and (f) said spring-biased members being moved against said bias during operation of the single facer to provide spaces for passage of gas through said openings to provide said gaseous layer.

2. In a single facer including a corrugating roll having flutes extending along its peripheral surface for forming a corrugating web, (a) a pressure member opposed to said corrugating roll for pressing a liner web against the corrugated web to form a single-faced corrugated board;

(b) said pressure member having an arcuate surface substantially conforming to the contour of an arc extending through the tips of said flutes and having a length in the circumferential direction of said roll which is greater than the distance between two adjacent flutes thereof;

(c) means for providing a gaseous layer between said arcuate surface of said pressure member and the liner web;

(d) said pressure member including a chamber for receiving gas and said means for providing said gaseous layer includes a plurality of openings formed in said chamber;

(e) a plurality of hollow plugs received in said openings, each of said plugs being received in a corresponding one of said openings;

(f) each of said plugs including an aperture providing communication with said chamber and having an opening adjacent said arcuate surface for admitting gas between said arcuate surface and the liner web;

(g) a ball within each of said plugs for closing said opening in said plug; and (h) means for biasing said ball toward said plug opening for closing said opening and causing a portion of said ball to project beyond said arcuate surface;

(i) said balls being moved inwardly against said biasing means during operation of the single facer to permit passage of gas through said plug openings for providing said gaseous layer.

3. In a single facer including a corrugating roll having flutes extending along its peripheral surface for forming a corrugating web, (a) a pressure member opposed to said corrugating roll for pressing a liner web against the corrugated web to form a single-faced corrugated board;

(b) said pressure member having an arcuate surface substantially conforming to the contour of an arc extending through the tips of said flutes and having a length in the circumferential direction of said roll which is greater than the distance between two adjacent flutes thereof;

(c) means for providing a gaseous layer between said arcuate surface of said pressure member and the liner web;

(d) said pressure member including a chamber for receiving gas and said means for providing said gaseous layer includes a plurality of openings formed in said arcuate surface and communicating with said chamber;

(e) a plurality of hollow plugs received in said openings, each of said plugs being received in a corresponding one of said openings;

(f) each of said plugs including an aperture providing communication with said chamber and having a tapered opening adjacent said arcuate surface for admitting gas between said arcuate surface and the liner web;

(g) a ball within each of said plugs adjacent said tapered opening; and (h) a spring within each of said plugs for biasing the corresponding one of said balls into engagement with the plug for closing the tapered opening and causing a portion of each ball to project beyond said arcuate surface;

(i) said balls being moved inwardly against said spring bias during operation of the single facer to provide space between each ball and the plug at said tapered opening to permit passage of gas for providing said gaseous layer.

4. The apparatus of claim 2 wherein:

(a) said openings in said arcuate surface are threaded; and (b) said plugs are externally threaded for threaded engagement with said openings.

* * * * *